United States Patent [19]

Chiang et al.

[11] Patent Number: 5,024,989

[45] Date of Patent: Jun. 18, 1991

[54] PROCESS AND MATERIALS FOR THERMAL IMAGING

[75] Inventors: Yunn H. Chiang, Andover, Mass.; Russell A. Gaudiana, Merrimack, N.H.

[73] Assignee: Polaroid Corporation, Cambridge, Mass.

[21] Appl. No.: 514,169

[22] Filed: Apr. 25, 1990

[51] Int. Cl.[5] ..... B41M 5/035; B41M 5/26

[52] U.S. Cl. ..... 503/227; 8/471; 428/1; 428/195; 428/336; 428/412; 428/480; 428/500; 428/913; 428/914

[58] Field of Search ..... 8/471; 428/1, 195, 913, 428/914, 336, 412, 480, 500; 503/227; 427/256

[56] References Cited

U.S. PATENT DOCUMENTS

| | | | |
|---|---|---|---|
| 2,616,961 | 11/1952 | Groak | 178/5.2 |
| 3,088,028 | 4/1963 | Newman | 250/65 |
| 3,147,377 | 9/1964 | Newman | 250/65 |
| 3,177,086 | 4/1965 | Newman et al. | 117/36.1 |
| 3,195,455 | 7/1964 | Newman | 101/149.5 |
| 3,924,041 | 12/1975 | Miyayama et al. | 428/212 |
| 4,098,301 | 7/1978 | Bloom et al. | 141/7 |
| 4,109,937 | 8/1978 | Gager | 282/27.5 |
| 4,321,404 | 3/1982 | Williams et al. | 560/115 |
| 4,555,427 | 11/1985 | Kawasaki | 430/201 |
| 4,587,198 | 5/1986 | Fisch | 430/201 |
| 4,602,263 | 7/1986 | Borrer et al. | 346/201 |
| 4,637,896 | 1/1987 | Shannon | 252/299.7 |
| 4,650,836 | 3/1987 | George et al. | 525/444 |
| 4,670,307 | 6/1987 | Onishi et al. | 427/261 |
| 4,720,480 | 1/1988 | ito et al. | 503/227 |
| 4,755,396 | 7/1988 | Geisler et al. | 427/197 |
| 4,794,067 | 12/1988 | Grasshoff et al. | 430/213 |
| 4,801,949 | 1/1989 | Misono et al. | 346/76 |
| 4,803,496 | 2/1989 | Kawakami et al. | 346/76 PH |
| 4,855,758 | 8/1989 | Kuwabata et al. | 346/76 PH |

FOREIGN PATENT DOCUMENTS

| | | | |
|---|---|---|---|
| 133011 | 2/1985 | European Pat. Off. | 428/195 |
| 133012 | 2/1985 | European Pat. Off. | 428/195 |

*Primary Examiner*—Bruce H. Hess

*Attorney, Agent, or Firm*—David J. Cole

[57] ABSTRACT

A process for thermal imaging uses a donor sheet and a receiving sheet. The donor sheet comprises a support and a dye capable of being transferred by heat, while the receiving sheet is adapted to receive the dye and thereby form an image. The donor and receiving sheets are placed adjacent one another, and at least one of the adjacent faces of the donor and receiving sheets has a layer of a polymeric liquid crystal thereon. Selected portions of the donor sheet are heated so as to transfer dye from the donor sheet to the receiving sheet, thereby forming an image on the receiving sheet.

32 Claims, 3 Drawing Sheets

PROCESS AND MATERIALS FOR THERMAL IMAGING

BACKGROUND OF THE INVENTION

This invention relates to a process and materials for thermal imaging.

It has long been known that images can be formed by thermal imaging processes in which a donor sheet comprising a dye is placed adjacent a receiving sheet and selected portions of the donor sheet are heated to effect an imagewise transfer of the dye from the donor sheet to the receiving sheet, thereby forming the image on the receiving sheet. One such process is described in U.S. Pat. No. 2,616,961, issued Nov. 4, 1952; this patent notes that the heating of the donor sheet need not be effected by direct contact of the donor sheet with a hot object, but may be effected by exposing the donor sheet to radiant energy (for example, infra-red radiation) or corpuscular energy (for example, an electron beam). U.S. Pat. No. 3,147,377, issued Sept. 1, 1964, describes a similar process for production of color transparencies.

U.S. Pat. No. 3,924,041, issued Dec. 2, 1975, describes a heat-sensitive recording material comprising a first support, a transfer layer, and a second support on the opposed side of the transfer layer from the first support. The materials in these three layers are chosen such that before heating the adhesion strength between the transfer layer and the second support is smaller than the adhesion strength between the transfer layer and the first support, but, after heating to a temperature higher than the heat sensitive temperature of the transfer layer, the adhesion strength between the transfer layer and the second support becomes greater than the adhesion strength between the transfer layer and the first support. The transfer layer comprises, at least on the side in contact with the second support, a heat-sensitive composition containing as a major component a mixture of a heat-sensitive substance which is fluidized at a heat-sensitive temperature and an adhesiveness-imparting agent which can adhere to the second support at a temperature no higher than this heat-sensitive temperature.

Thermal imaging processes can be used for producing color images by successively superimposing a plurality of donor sheets over a single receiving sheet, with each donor sheet bearing a differently-colored dye, and heating only those portions of each donor sheet in which the corresponding color is required in the image. Typically, such color processes use three donor sheets providing yellow, cyan and magenta dyes, or four donor sheets providing yellow, cyan, magenta and black dyes. A process of the latter type is described in U.S. Pat. No. 4,803,496, issued Feb. 7, 1989; this patent describes adjustment of the area where the black ink is applied to prevent darkening of the image and resultant loss of color balance.

U.S. Pat. No. 4,587,198, issued May 6, 1986, describes a process for providing a color image comprising exposing a radiation sensitive layer over a vapor deposited colorant layer, and vaporizing the colorant to selectively transmit the colorant through the exposed layer. The change in solubility, permeability and/or crosslinking or polymerization of the exposed radiation sensitive layer causes differential migration of colorant through the exposed layer.

U.S. Pat. No. 4,602,263, issued July 22, 1986, describes a thermal imaging method for forming color images; this method relies upon the irreversible unimolecular fragmentation of one or more thermally unstable carbamate moieties of an organic compound to effect a visibly discernible color shift from colorless to colored or from one color to another.

U.S. Pat. No. 4,801,949, issued Jan. 31, 1989, describes a thermal imaging system in which a layer of rupturable capsules are formed on a sheet of paper, the coated sheet is exposed and the microcapsules are subjected to a uniform rupturing force, whereupon exposed microcapsules rupture and imagewise release chromogenic material contained within the capsules.

Recently, thermal transfer processes have been used commercially in printers intended for use as output devices for computers or other electronic data recording equipment, including cameras in which the image is recorded electronically on a magnetic medium. In such printers, the donor sheet is scanned by a thermal printing head having a plurality of small heating elements, so that the image on the receiving sheet is composed of a large number of dots each formed by one of the heating elements, in the same way that a conventional dot-matrix printer using an ink ribbon forms an image comprising a large number of ink dots. Such a thermal transfer printer is described in U.S. Pat. No. 4,855,758, issued Aug. 8, 1989; the printer described in this patent uses an electroconductive ink on the donor sheet and an electrode in physical contact with the donor sheet to prevent any path for electricity being formed between the donor sheet and the printing head.

U.S. Pat. No. 4,720,480, issued Jan. 19, 1988, describes donor and receiving sheets intended for use in such a thermal transfer printer. The face of the donor sheet which contacts the thermal printing head is provided with a heat-resistant slipping layer to prevent adhesion of the thermal printing head to the donor sheet. The receiving sheet comprises a base sheet, a receptive layer for receiving the dye transferred from the donor sheet, and an intermediate layer provided between these two layers, this intermediate layer having a low modulus of elasticity so that it becomes deformed during printing. The patent states that such deformation of the intermediate layer improves dye transfer from the donor sheet to the receiving sheet.

U.S. Pat. No. 4,755,396, issued July 5, 1988, describes an image receiving element for thermal printers, this element comprising a substrate bearing on at least one major surface thereof a coating of heat-sensitive material comprising a material capable of existing in a supercooled state after melting and subsequent cooling, at least one anti-fouling agent, and, optionally, a binder. The coating is stated to reduce the amount of material which fouls a thermal printing head contacting the image receiving element.

U.S. Pat. No. 4,555,427, issued Nov. 26, 1985, describes a receiving sheet for use in a thermal printing process, this receiving sheet having an image receiving layer comprising mutually independent islands of a first synthetic resin having a glass transition temperature of from −100° to 20° C. and having a polar group, and a second synthetic resin having a glass transition temperature of 40° C. or above.

One of the problems in any thermal imaging process (or indeed in any process which relies upon the formation of an image by transfer of dye from a donor sheet to a receiving sheet, whatever method is used to effect such transfer) is ensuring sufficient transfer of the dye to produce an image of the requisite density on the receiving sheet. To assist dye transfer, and thus enhance image density, attempts have been made to provide the donor and/or receiving sheets with materials which assist in release of dye from the donor sheet or take-up of dye by the receiving sheet. For example, U.S. Pat. No. 3,088,028, issued Apr. 30, 1983, describes a heat duplicating system using a donor sheet having a heat-meltable coating. The receiving sheet (copy paper) used in this system can be provided on its image-receiving surface with a heat-modifiable, heat-softenable or low-melting solid, which when heated softens and becomes variously otherwise modified into a state in which it is a solvent for the dye.

U.S. Pat. No. 3,177,086, issued Apr. 6, 1965, describes a pressure-sensitive transfer in which the donor sheet ("transfer sheet") comprises a flexible foundation carrying a volatile, solvent-applied, heat-resistant frangible transfer layer substantially completely transferable to the receiving sheet ("master sheet"). The donor or receiving sheet may be coated with a film having an affinity when hot for both the receiving sheet and the transfer layer; this film is stated to effect a better, more complete transfer of the transfer layer after cooling and separation of the donor sheet from the receiving sheet.

U.S. Pat. No. 3,195,455, issued July 20, 1965, describes a thermal duplicating process in which the receiving sheet ("copy sheet") is coated with a film of a heat-meltable solid developer which when heated softens and becomes fluid and is thus converted into a solvent for the dye being transferred on to the receiving sheet.

U.S. Pat. No. 4,109,937, issued Aug. 29, 1978, describes a donor sheet for use in thermal imaging, this donor sheet comprising a substrate sheet having a coating comprising an organic acid which is volatilizable at thermal imaging temperatures, an additive consisting essentially of a fatty acid having from 10 to 26 carbon atoms or a metal salt thereof, and a polymeric binder compatible with the volatilizable acid. The presence of the additive is stated to control the physical nature of the acid layer and the subsequent volatility of the acid, thereby providing a composition which produces sharp, easily readable, permanent and dense images.

U.S. Pat. No. 4,321,404, issued Mar. 23, 1982, describes radiation curable coating compositions comprising polyfluorinated acrylates and methacrylates, polyethylenically unsaturated crosslinking agents and a film-forming organic polymer. There compositions are useful as release coatings in image transfer systems wherein a fused thermographic image is transferred from a release-coated surface to another surface.

U.S. Pat. No. 4,670,307, issued June 2, 1987, describes a thermal transfer recording sheet produced by placing, on one side of a sheet-like, heat-resistant substrate successively along the surface, one or more thermal transfer recording layers containing a recording material which contains a binder material and a coloring material and whose viscosity is lowered and controlled by temperature-raise recording control, so that transferability to recording medium is imparted, and a thermal transfer coating layer containing a hot-melt material which is miscible (compatible) with at least a part of the binder material. Thermal transfer recording using this sheet is effected by first subjecting the thermal transfer coating layer to temperature-raise recording control, forming a film of the hot-melt material on the surface of the recording medium at least on a portion to which the recording material is transferred, and conducting thereon thermal transfer recording as usual. The patent states that this reduces unevenness of transfer due to unevenness of the material receiving the coloring material, thereby enabling recording sensitivity to be improved.

Despite the efforts which have been made to improve dye transfer from a donor sheet to a receiving sheet, incompleteness and non-uniformity of dye transfer remain serious problems in thermal imaging. These problems are especially acute in thermal transfer printers, because of the brief contact time between the thermal printing head and any one pixel of the image, and because of the need to control closely not only the color but also the optical density of each pixel. For example, a 4 by 4 inch (102×102 mm.) image having a relatively low resolution of 100 dots per inch (about 4 dots per millimeter) contains 160,000 pixels of each color, or a total of 480,000 pixels for a three-color process. If such a print is to be produced in (say) two minutes using a print head containing 100 discrete heating elements, the contact time between a single heating element and each pixel cannot exceed 0.025 seconds. Even if only 16 levels of optical density of each color are required, it will readily be apparent that the requirements for speed and reproducibility of dye transfer in such a thermal imaging process are highly exacting. Furthermore, since any dye which cannot be transferred from the donor sheet to the receiving sheet within the brief contact time (even when the thermal printing head is set for maximum heating of a specific pixel) is effectively wasted, the lower the proportion of dye which can be transferred to the receiving sheet, the larger the amount of dye which must originally be present on the donor sheet, and the higher the cost of the donor sheet.

There is thus a need for a thermal imaging process which can achieve a high rate of dye transfer from a donor sheet to a receiving sheet, and the present invention provides such a process and materials for use therein.

SUMMARY OF THE INVENTION

This invention provides a process for thermal imaging using a donor sheet and a receiving sheet, the donor sheet comprising a support and a dye capable of being transferred by heat, and the receiving sheet being adapted to receive the dye and thereby form an image. The process comprises placing the donor and receiving sheets adjacent one another, a polymeric liquid crystal being present at the interface between the donor and receiving sheets, and heating selected portions of the donor sheet so as to transfer dye from the donor sheet to the receiving sheet, thereby forming an image on the receiving sheet.

This invention also provides sheet material for use in thermal imaging, the sheet material comprising a donor sheet and a receiving sheet, the donor sheet comprising a support and a dye capable of being transferred by heat, and the receiving sheet having on one of its faces an image receiving layer comprising a polymeric liquid crystal.

This invention also provides an image receiving element having a surface comprising polymeric liquid crystal adapted to receipt of a dye image by contact with a donor sheet, the image receiving element comprising a support, an image receiving layer disposed on one face of the support and capable of receiving a dye to form an image, this image receiving layer being formed from an image receiving material which is not a liquid crystal, and a polymeric liquid crystal.

Finally, this invention provides an image receiving element having a surface comprising polymeric liquid crystal adapted to receipt of a dye image by contact with a donor sheet, the image receiving element comprising a support comprising a flexible layer of sheet material, and a layer of a polymeric liquid crystal on the face of the support, the polymeric liquid crystal layer being from about 0.5 to about 10 $\mu$ thick.

DETAILED DESCRIPTION OF THE INVENTION

Figure 1C:
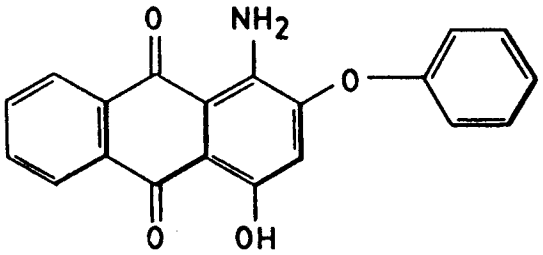
FIGS. 1A–1D of the accompanying drawings show the chemical formulae of the dyes used in the Examples below.

The term "dye" is used herein to mean any material which when applied to an appropriate receiving sheet produces a change in the transmission and/or reflectance characteristics of the receiving sheet under electromagnetic or other radiation. Thus, in addition to dyes which are inherently colored compounds as perceived by the human eye, the term "dye" as used herein includes (a) materials which change only the transmission and/or reflectance characteristics of the receiving sheet in non-visible electromagnetic radiation (for example, "invisible inks" which fluoresce in the visible region upon exposure to ultraviolet radiation); (b) materials which only develop color when contacted with another material (for example, acids which develop color when contacted with certain clays—in such cases, the acid is of course placed on the donor sheet and the clay on the receiving sheet); (c) materials which produce a visually discernible color shift from colorless to colored, from colored to colorless, or from one color to another, upon contact with an appropriate receiving sheet. The dye must of course be one which can be transferred from the donor sheet to the receiving sheet by heat.

The term "image" is used herein to refer to any arrangement on the receiving sheet of areas which exhibit differing transmission and/or reflectance characteristics under electromagnetic or other radiation. Thus, the term "image" is used herein to include not only graphic or pictorial images but also textual material and quasi-textual material for machine "reading", for example, bar codes.

The term "liquid crystal" is used herein to mean any material which, over a limited temperature range, has an anisotropic liquid phase which is birefringent and exhibits interference patterns in polarized light. It is not required that the material be in an anisotropic liquid phase at room temperature, since when transfer of the dye from the donor sheet to the receiving sheet occurs in the present process, the polymeric liquid crystal will normally be heated substantially above room temperature, although when a thermal printing head is used, the temperature of the liquid crystal will remain lower than that of the head. The polymeric liquid crystal material chosen for use in any specific process of the present invention should be one which exhibits liquid crystal (mesomorphic) properties at the temperature of the material during dye transfer.

Liquid crystals are well known to those skilled in the field of materials sciences; see, for example, Chandrasekar, S., Liquid Crystals, Cambridge University Press, New York (1977) and Dennis, D., and Richter, L., Textures of Liquid Crystals, Verlag Chemie Weinheim, New York (1978). See also U.S. Pat. No. 4,650,836, which describes various polymer liquid crystals and a method for rendering melt processable a liquid crystal polymer not readily processable as a result of an interfering degradation temperature or an elevated viscosity. In this method, the liquid crystal polymer is blended with a second, low molecular weight liquid crystal diester to form a miscible mesophase which is typified by a reduced viscosity and/or at a lower temperature may be formed into a desired configuration. The low molecular weight liquid crystal may then be transesterified into the polyester to produce a long chain having desirable final liquid crystal polymer properties.

Compositions containing liquid crystals in admixture with dyestuffs are known; for example, U.S. Pat. No. 4,098,301, issued July 4, 1978, describes a method for providing homogeneous liquid crystal cells containing a dyestuff; in this method, filled liquid crystal cells containing a soluble, pleochroic dyestuff are treated by heating above the nematic to isotropic liquid transition temperature until the cells appear uniformly colored. However, it has not previously been proposed to use liquid crystal coatings to assist dye transfer in a thermal imaging process.

In the process of the present invention, a polymeric liquid crystal is present at the interface between the donor and receiving sheets. Preferably, the receiving sheet comprises the polymeric liquid crystal.

While the thickness of the polymeric liquid crystal may vary with a number of factors, including the specific liquid crystal employed and the nature of the other layers, in general the liquid crystal on the receiving sheet is desirably from about 0.5 to about 10 $\mu$, and preferably from about 1 to about 6 $\mu$, thick. Coatings within these thickness ranges, which correspond to coating weights of about 50 to 1,000 mg/ft$^2$., can readily be applied to the thermal imaging donor and receiving sheets by conventional techniques which will be familiar to those skilled in the art of preparing such sheet materials. Although other techniques, such as dip coating or spray coating may be employed, in general, the liquid crystal is most conveniently applied by solvent coating, that is to say dissolving the liquid crystal in an appropriate solvent (chloroform is often employed), coating this solution onto the sheet, and drying the sheet to produce a layer of the liquid crystal on the sheet. The coating step may be performed by hand coating or by mechanical coating apparatus. Drying may be in ambient temperature or may be assisted by moderate heating of the sheet.

In some cases, especially where it is desired to apply polymeric liquid crystal to commercial donor sheets, solvent coating may be undesirable because the solvent may tend to distort the donor sheet. In such cases, the polymeric liquid crystal may be applied by a transfer process, in which a layer of the liquid crystal is first solvent coated onto a temporary support (typically a plastic film) and dried, and thereafter the temporary support is laminated to the donor sheet under elevated temperature and pressure, so transferring the layer of liquid crystal to the donor sheet. Finally, the temporary support is peeled from the donor sheet to leave the donor sheet bearing the layer of liquid crystal.

While other types of polymeric liquid crystals may be employed, the preferred liquid crystal for use of the present invention is a polymeric polyester. One especially preferred type of polymeric polyester is a polymer of an aliphatic dicarboxylic acid and an aromatic dihydroxylic phenol, especially those in which the aliphatic dicarboxylic acid comprises azelaic acid and the aromatic dihydroxylic phenol comprises at least one of a methylquinol and 4,4'-bisphenol. A second especially preferred type of polymeric polyester is a polymer of an aromatic hydroxy acid and an alkylene glycol, especially those in which the aromatic hydroxy acid is at least one of p-hydroxybenzoic acid and a halo-p-hydroxybenzoic acid, and the alkylene glycol is ethylene glycol.

It has been found that the molecular weight of the polymeric liquid crystal significantly affects its performance in the present process. It appears that, typically, as the molecular weight of the polymeric liquid crystal increases, its image receiving properties rise until an optimum molecular weight is achieved, and then decrease with further increases in molecular weight. The optimum molecular weight for any specific type of polymeric liquid crystal may easily be determined by routine empirical tests. Typically, the optimum molecular weight for the presently-preferred types of liquid crystals will be around 5,000.

Apart from the polymeric liquid crystal, the materials used in the process of the present invention can be those conventionally used in thermal imaging donor and receiving sheets. Thus, the dye used in the present process can be any of those used in prior art thermal imaging processes. Typically, such a dye is a heat-sublimeable dye having a molecular weight of the order of about 150 to 800, preferably 350 to 700. In considering what specific dye should be employed in a particular case, it may be necessary to take account of factors such as heat sublimation temperature, hue, compatibility with any binder used in the donor sheet and compatibility with the polymeric liquid crystal and any other image receiving materials on the receiving sheet. Specific dyes previously found to be useful in thermal imaging processes include:

Color Index (C.I.) Yellows Nos. 3, 7, 23, 51, 54, 60 and 79;

C.I. Disperse Blues Nos. 14, 19, 24, 26, 56, 72, 87, 154, 165, 287, 301 and 334;

C.I. Disperse Reds Nos. 1, 59, 60, 73, 135, 146 and 167;

C.I. Disperse Violets Nos. 4, 13, 31, 36 and 56;

C.I. Solvent Violet No. 13;

C.I. Solvent Black No. 3;

C.I. Solvent Green No. 3;

C.I. Solvent Yellows Nos. 14, 16, 29 and 56;

C.I. Solvent Blues Nos. 11, 35, 36, 49, 50, 63, 97, 70, 105 and 111; and

C.I. Solvent Reds Nos. 18, 19, 23, 24, 25, 81, 135, 143, 146 and 182.

Figure 1D:
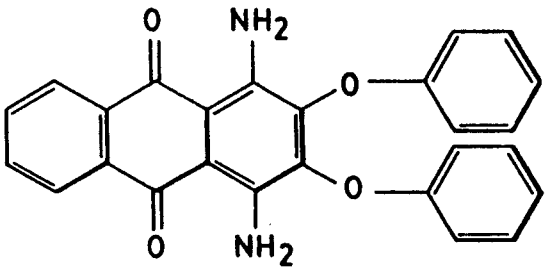
Figure 1A:
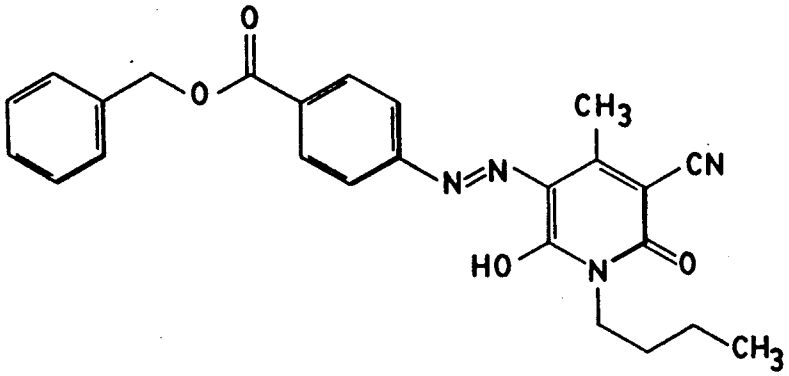
Figure 1B:
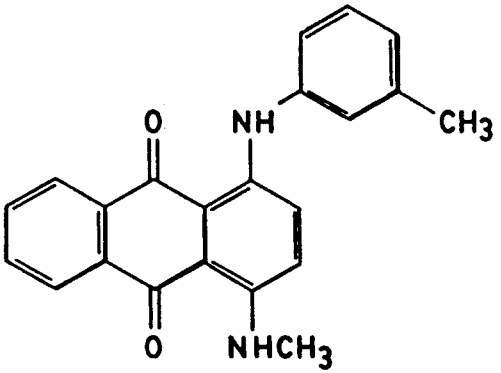

One specific set of dyes which have been found to give good results in a three-color thermal imaging process of the present invention are:

Yellow C.I. Disperse Yellow No. 231, also known as Foron Brilliant Yellow S-6GL (see FIG. 1A of the accompanying drawings);

Cyan C.I. Solvent Blue No. 63, C.I. No. 61520, 1-(3'-methylphenyl)amino-4-methylaminoanthraquinone (see FIG. 1B);

Magenta A mixture of approximately equal amounts of C.I. Disperse Red No. 60, C.I. No.60756, 1-amino-2-phenoxy-4-hydroxyanthraquinone (see FIG. 1C), and C.I. Disperse Violet No. 26, C.I. No. 62025, 1,4-diamino-2,3-diphenoxyanthraquinone (see FIG. 1D).

The donor sheet used in the present process conveniently comprises a dye layer disposed on one face of the support, the dye layer comprising the dye and a binder for the dye; during thermal imaging, the dye layer on the support of course faces the receiving sheet. The support may be paper, for example condenser paper, or a plastic film, for example an aromatic polyamide film, a polyester film, a polystyrene film, a polysulfone film, a polyimide film or a polyvinyl film. The thickness of the support is usually in the range of about 2 to about 50 $\mu$, although when the donor sheet is to be used in a thermal printing process it is desirably to keep the thickness of the support in the range of about 2 to about 15 $\mu$, since a thick support delays heat transfer from the printing head to the dye and may affect the resolution of the image produced. A donor sheet having a 10 $\mu$ polyethylene terephthalate support has been found to give good results in the present process.

The dye binder serves to keep the dye dispersed uniformly across the donor sheet and to prevent release of the labile, relatively low molecular weight dye except where the donor sheet is heated during the thermal imaging process. Although other resins including cellulose resins (for example, ethylcellulose, hydroxyethylcellulose, ethylhydroxyethylcellulose, hydroxypropylcellulose, cellulose acetate, and cellulose acetate butyrate) and vinyl resins (for example, polyvinyl alcohol, polyvinyl pyrrolidone, polyvinyl acetate) and polyacrylamide resins may be employed as binders, preferred binders are vinyl alcohol/vinyl buryral copolymers. Such copolymers desirably contain from about 10 to about 40 percent by weight polyvinyl alcohol, based upon the total weight of the copolymer, and have a molecular weight in the range of about 60,000 to about 200,000, and a glass transition temperature of at least about 60° C., preferably at least about 70° C., and no more than 110° C. Desirably the weight ratio of dye to binder is in the range of from about 0.3:1 to about 2.55:1, preferably about 0.55:1 to about 1.5:1.

When the process of the present invention is a thermal printing process, desirably a layer of a lubricating agent is provided on the face of the donor sheet remote from the dye layer, the lubricating agent serving to reduce adhesion of a thermal printing head to the donor sheet. Such a layer of lubricating agent (also called "heat-resistant slipping layers"), and methods for its creation on a donor sheet are described in detail in the aforementioned U.S. Pat. No. 4,720,480, and hence such lubricating agents will not be described in detailed herein. A preferred lubricating agent comprises (a) a reaction product between polyvinyl butyral and an isocyanate; (b) an alkali metal salt or an alkaline earth metal salt of a phosphoric acid ester; and (c) a filler.

This lubricating agent may also comprise a non-salified phosphoric acid ester.

The filler used in this preferred lubricating agent can be an inorganic or organic filler having heat resistance, for example, clay, talc, a zeolite, an aluminosilicate, calcium carbonate, polytetrafluoroethylene powder, zinc oxide, titanium oxide, magnesium oxide, silica and carbon. Good results have been achieved in the present process using a lubricating layer containing as filler talc particles with an average size of 1 to 5 $\mu$.

Because it is desirable to keep the donor sheet thin, for reasons already discussed above, the thickness of the lubricating layer preferably does not exceed about 10 $\mu$.

In the receiving sheet of the present invention, the polymeric liquid crystal may be the only material adapted to receive the dye and thereby form an image; thus, a receiving sheet for use in the present process may simply comprise a support comprising a flexible layer of sheet material (for example, paper or a plastic film), and a layer of a polymeric liquid crystal on the face of the support, the polymeric liquid crystal layer being (typically) from about 0.5 to about 10 || thick.

Alternatively, the receiving sheet may comprise, in addition to the liquid crystal, an image receiving material which is not a liquid crystal. The non-liquid crystal image receiving material may be present either admixed with the liquid crystal in a single layer, or as a layer separate from the liquid crystal layer. In the latter case, the layers should be arranged so that when the receiving sheet is disposed adjacent the donor sheet, the polymeric liquid crystal layer lies closest to the donor sheet with the layer of non-liquid crystal image receiving material lying behind the liquid crystal layer. Thus, a receiving sheet of the present invention can be formed simply by coating a liquid crystal layer onto one face of a prior art receiving sheet which already has a non-liquid crystal image receiving material on that face. In has been found empirically, however, that when a liquid crystal is coated onto an existing image receiving layer, microscopic examination of the resulting receiving sheet sometimes fails to reveal any visible boundary between the liquid crystal layer and the non-liquid crystal image receiving layer. The reason for the absence of the expected boundary is not entirely understood at present, but in any event does not affect the improved results achieved by incorporating the liquid crystal into the receiving sheet.

When such a non-liquid crystal image receiving material is provided in the receiving sheet, it may be any of the image receiving materials hitherto used in such sheets. For example, a polyester, polyacrylate, polycarbonate, poly(4-vinylpyridine), polyvinyl acetate, styrene-acrylate, polyurethane, polyamide, polyvinyl chloride or polyacrylonitrile resin may be used as the image receiving material. Desirably, the image receiving material is formed from an acrylate resin, a preferred resin for this purpose being polymethyl methacrylate. The image-receiving layer might also be formed from gelatin or a polymer mordant such as described in U.S. Pat. No. 4,794,067, issued Dec. 27, 1988; the polymers described in this patent comprise a mixture of a quaternary ammonium copolymeric mordant of the formula:

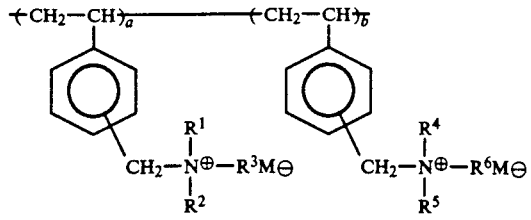

(wherein each of $R^1$, $R^2$ and $R^3$ is independently alkyl of from 1 to 4 carbon atoms; each of $R^4$, $R^5$ and $R^6$ is independently alkyl of from 1 to 18 carbon atoms and the total number of carbon atoms in $R^4$, $R^5$ and $R^6$ is from 13 to 20; each M is an anion; and each of a and b is the molar proportion of each of the respective repeating units) and a hydrophilic polymer. One specific material of this type comprises a mixture of approximately equal weights of a copolymer in which $R^1$, $R^2$, $R^3$, $R^4$ and $R^5$ are all methyl groups and $R^6$ is a dodecyl group, with polyvinyl alcohol. The thickness of the layer of non-liquid crystal image receiving material will typically be in the range of about 0.5 to about 5 $\mu$.

When the polymeric liquid crystal layer is present in is contact with another image receiving layer, it may, at least in some cases, be desirable for the polymeric liquid crystal to be soluble in the other image receiving layer, and such solubility should be taken into account when choosing specific materials for the polymeric liquid crystal layer and the image receiving layer. In some cases, it may be desirable to include a surfactant in the polymeric liquid crystal layer to enhance its solubility in the other image receiving layer.

In addition to the polymeric liquid crystal layer and any other image receiving layer, the receiving sheet will normally comprise a support, which serves to provide mechanical strength to the receiving sheet and the finished image produced therefrom. Such a support may be formed from a paper, coated paper or a plastic film. A preferred plastic film for this purpose is polyethylene terephthalate. Advantageously, the plastic film includes a filler which renders the film opaque, so that the image is seen against the opaque background provided by the support. The filler may be, for example, calcium carbonate. Typically, the support will have a thickness of from about 5 to 500 $\mu$, desirably 50 to 250 $\mu$.

To prevent peeling or other damage to the image receiving layer and/or the finished image, it is necessary to secure a high degree of adhesion of the polymeric liquid crystal layer and any other image receiving layer to the support. To increase this adhesion, is desirable to provide, on the face of the support which carries the polymeric liquid crystal layer and any other image receiving layer, a subcoat able to increase the adhesion.

The process of the present invention can produce images having greater reflectance density than those formed using similar donor and receiving sheets without the polymeric liquid crystal layer. This increase in density appears to be due to the action of the polymeric liquid crystal layer in facilitating dye transfer to the receiving sheet. The process of the present invention may also be useful in permitting reduction of the amount of dye in the donor sheet while still producing the same reflectance density in the image. Furthermore, at least in some cases, the present process appears to improve the perceived sharpness of the image, apparently because the enhanced dye transfer provided by the polymeric liquid crystal layer reduces lateral diffusion of the dye across the image.

It has been found that the polymeric liquid crystal nature of the materials employed is important in securing the advantages of the present invention. The present inventors have conducted experiments with a number of non-polymeric liquid crystals and have found no apparent improvement in dye transfer. Moreover, similar experiments using low-melting polymers, or paraffin wax, which do not exhibit liquid crystal properties also showed little or no improvement in dye transfer.

The following Examples are now given, though by way of illustration only, to show details of preferred reagents, conditions and techniques used in the present invention.

EXAMPLES

Example 1

Preparation of polymeric liquid crystals

Figure 2A:
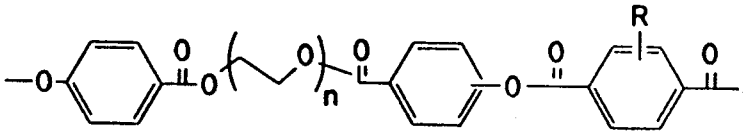
FIGS. 2A and 2B shows the chemical formulae of preferred polymeric liquid crystals used in the present process.
Figure 2B:
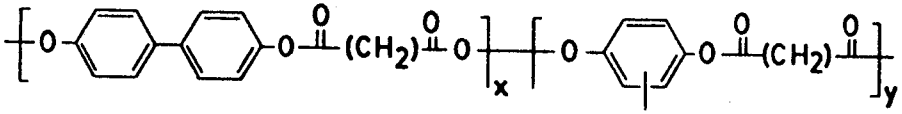

This Example illustrates the preparation of preferred polymeric liquid crystals of Formulae (I) and (II) shown in FIGS. 2A and 2B respectively for use in the process of the present invention.

A: Preparation of liquid crystal of Formula (I)

0.5 G. (1.28 mmole) of the diol of formula (p—O-H—$\phi$)—CO—O—$CH_2CH_2$—O—$CH_2CH_2$—O—$CH_2CH_2$—O—CO—(p—OH—$\phi$) where $\phi$ represents a phenyl group, was dissolved in chloroform and stirred. To this solution was added dropwise over a period of ten minutes at room temperature 0.89 ml. (6.4 mmole) of triethylamine. A solution of 0.361 g. (1.28 mmole) of bromoterephthalyl dichloride in chloroform was then added dropwise from a plastic pipet, and the resultant reaction mixture was stirred for three hours at room temperature, after which time the infra-red spectrum of the reaction mixture showed no carbonyl absorption attributable to the acid chloride.

The reaction mixture was partitioned between chloroform and 1N hydrochloric acid, and the chloroform layer thereafter washed successively with water and 8M sodium chloride solution. The chloroform solution (circa 100 ml.) was added dropwise into 3 l. of rapidly stirred hexane. The resultant precipitate proved too sticky to filter, so it was allowed to sit in hexane overnight and then filtered and placed in a vacuum at room temperature for 6 hours.

The polymer was found to have an inherent viscosity of 0.183 dl/g. Similar polymers having inherent viscosities of 0.353, 0.284 and 0.279 dl/g. were prepared in a similar manner.

B: Preparation of liquid crystal of Formula (II)

5.58 G. (0.03 mole) of 4,4'-biphenol, 3.72 g. (0.03 mole) of methyl hydroquinone, 100 ml. of methylene chloride and 18 g. of triethylamine were all placed in a 250 ml. four-necked round-bottomed flask. The mixture was then cooled for 15 minutes in a cold water bath until its temperature had been lowered to 15° C. 8.86 ml. (10.13 g., 0.045 mole) of azelaic acid dichloride was added over a 30 minute period using a polyethylene pipette, and the resulting solution was stirred for 3 hours at 25° C., then taken up in chloroform and the resultant solution washed with 1N hydrochloric acid and with three 100 ml. portions of distilled water. The solution was poured into hexane and the precipitate filtered off, washed with hexane, air-dried over a weekend and placed under vacuum at 50° C. The polymer was found to have an inherent viscosity of 0.32 dl/g. Similar polymers having inherent viscosities of 0.24, 0.84 and 0.93 dl/g. were prepared in a similar manner.

C: Properties of polymeric liquid crystals

Measurements were made of the dynamic viscosity at 160° C., the inherent viscosity in chloroform, and the number average molecular weight ($M_n$) of the liquid crystals prepared in Parts A and B above. The crystalline-nematic (K-N) and nematic-isotropic (N-I) transition temperatures were also measured by both microscopic and differential scanning calorimetric methods. The results are shown in Table 1 below.

TABLE 1

| Formula of Polymer | Dynamic Viscosity (P) | Inherent Viscosity (dl/g) | $M_n$ | Microscope K-N (°C.) | Microscope N-I (°C.) | DSC K-N (°C.) | DSC N-I (°C.) |
|---|---|---|---|---|---|---|---|
| I, R = Br, n = 3 | 856 | 0.18 | 8990 | 110 | 134 | 88 | 117 |
| I, R = Br, n mixed | — | 0.353 | 14731 | | | | |
| I, R = Br, n mixed | — | 0.284 | 15230 | | | | |
| I, R = Br, n mixed | — | 0.279 | 16695 | | | | |
| II, R = $CH_3$ x/y = 1 | 47000 | 0.24 | 4771 | 137 | 186 | 127 | 177 |
| II, R = $CH_3$ x/y = 1 | — | 0.32 | 5510 | 132 | 188 | 125 | 172 |
| II, R = $CH_3$ x/y = 1 | — | 0.84 | — | 164 | 207 | 166 | 200 |
| II, R = $CH_3$ x/y = 1 | 200000 | 0.93 | 7266 | 145 | 196 | 167 | 195 |

Example 2

Preparation and use of receiving sheet of the present invention

This Example illustrates the preparation of a receiving sheet of the present invention and its use in a preferred embodiment of the present process.

Figure 3:
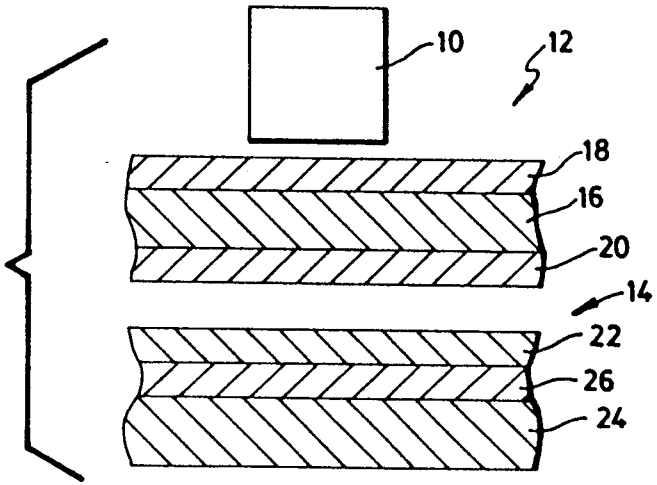
FIG. 3 is a schematic cross-section through a donor sheet and a receiving sheet being used in the process of the present invention.

FIG. 3 of the accompanying drawings shows schematically a thermal imaging process of the present invention in progress. As shown in FIG. 3, a thermal printing head 10 is heating selected portions of a donor sheet (generally designated 12), thereby transferring dye imagewise from the donor sheet 12 to a receiving sheet (generally designated 14) to form an image thereon. (For ease of illustration, the donor sheet 12 and receiving sheet 14 are shown spaced apart in FIG. 3; in practice, the two sheets are of course pressed into contact with one another by the printing head 10 during the thermal imaging process.)

Apart from the provision of a polymeric liquid crystal on the receiving sheet 14, the donor and receiving sheets shown in FIG. 3 are commercially available materials, being those sold by Hitachi, Ltd., Tokyo, Japan, for use with its VY-100A printer, although the donor sheet 12 is manufactured by Dai Nippon Insatsu Kabushiki Kaisha, of Japan. This printer uses a thermal imaging method to provide a color print of an image recorded on a magnetic medium and/or displayed on a video monitor.

According to the manufacturers, the donor sheet 12 comprises a support layer 16 of terephthalate polyester 10 $\mu$ in thickness. One face of this support layer 16 carries a lubricating layer 18, 5 $\mu$ in thickness and comprising a resin which softens at about 229° C. and which contains particles of calcium carbonate 1 to 5 μ in size. The opposed face of the support layer 16 carries a dye layer 20. This dye layer 20 is 2 to 5 μ in thickness and comprises a dye dispersed in a vinyl alcohol/vinyl butyral copolymer, which softens at 85° C. and serves as a binder for the dye.

The donor sheet 12 is supplied commercially in a cartridge generally similar in form to a conventional 110 or 126 film cartridge, but substantially larger since the donor sheet 12 is approximately 4 inches (102 mm.) wide. The donor sheet cartridge comprises a feed spool and a take-up spool, the two spools having parallel axes and each being disposed within a substantially light-proof, cylindrical, synthetic resin housing. The opposed ends of the two cylindrical housings are interconnected by a pair of parallel rails, so leaving between the two housings an open rectangular frame in which a single pane of the donor sheet 12 can be exposed.

In the commercial cartridge, the donor sheet 12 is in the form of a long roll comprising a plurality of panes, each pane containing a single color dye, with yellow, cyan and magenta panes being repeated cyclically along the film so that each triplet of three panes contains one pane of each color. One triplet of three panes is used for each print. The dyes used are as follows:

Yellow C.I. Disperse Yellow No. 231, also known as Foron Brilliant Yellow S-6GL;

Cyan C.I. Solvent Blue No. 63, C.I. No. 61520, 1-(3'-methylphenyl)amino-4-methylaminoanthraquinone;

Magenta A mixture of approximately equal amounts of C.I. Disperse Red No. 60, C.I. No.60756, 1-amino-2-phenoxy-4-hydroxyanthraquinone, and C.I. Disperse Violet No. 26, C.I. No. 62025, 1,4-diamino-2,3-diphenoxyanthraquinone.

The formulae of these preferred dyes are shown in FIGS. 1A–1D of the accompanying drawings. The dyes sublime at 140° 14 142° C.

The receiving sheet 14 shown in FIG. 3 comprises the commercial receiving sheet sold by Hitachi modified by the addition of a polymeric liquid crystal. According to the manufacturers, the commercial receiving sheet comprises a support layer 24 formed of polyethylene terephthalate film 150 μ in thickness and containing pigment particles, which act as an opacifying agent and render the base layer white in color, so that the images produced on the receiving sheet are seen against a white background. One face of the support layer 24 carries a subcoat 26, which is 8 to 10 μ in thickness and, superimposed over this subcoat 26, an image receiving layer, which is 1.5 to 2 μ in thickness and composed of polymethyl methacrylate which softens at 100° C. The subcoat 26 serves to increase the adhesion of the image receiving layer to the underlying support layer 24.

The polymeric liquid crystal required by the present invention is coated on the surface of the receiving sheet which carried the existing image receiving layer to form a unitary image receiving layer 22 containing both the polymeric liquid crystal and the original non-liquid crystal polymethyl methacrylate image receiving material. As shown in FIG. 3, during the thermal imaging process, this image receiving layer 22 lies adjacent the donor sheet 12. For experimental purposes, the polymeric liquid crystal was introduced into the layer 22 by dissolving the polymer of inherent viscosity 0.32 dl/g. described in Example 1 above in chloroform to form a 3 percent by weight solution, coating this solution onto discrete sheets of the commercial receiving sheet, and drying the coated sheets in air at ambient temperature to produce a receiving sheet in which the unitary layer 22 had a coverage of 300 mg/ft$^2$., corresponding to a thickness of pure liquid crystal of about 2 μ. It will be appreciated that, depending upon the nature of the image receiving and polymeric liquid crystal materials employed, a discrete layer of liquid crystal material can be deposited upon a layer of the image receiving material.

The receiving sheet 14 thus prepared was then used with the donor sheet 12 in a Hitachi VY-100A printer to produce 78 by 97 mm. color reflection prints having a nominal resolution of 150 lines per inch (i.e, the pixel array was 468 by 512 pixels) with a 64 grey tone scale using a power level of 120 watts and a printing time of 80 seconds per print. The original used for the experiment was a test pattern having a nine-step (including white and black areas) grey tone scale and areas of seven differing colors. Measurements of the total visual optical density, and cyan, magenta and yellow optical densities of each of the grey and colored areas, together with measurements of the background reflectance density were made by an X-Rite 338 photographic densitometer. To provide a control, the experiment was repeated using the commercial donor and receiving sheets (i.e., without the polymeric liquid crystal on the receiving sheet). The results are shown in Table 2 below, and the total visual optical density values of the background and grey tone scale are graphed in FIG. 4 of the accompanying drawings.

TABLE 2

| Control | | | | Present Invention | | | |
|---|---|---|---|---|---|---|---|
| Visual | Cyan | Magenta | Yellow | Visual | Cyan | Magenta | Yellow |
| Grey scale | | | | | | | |
| 0.007 (Background) | 0.005 | 0.007 | 0.009 | 0.08 | 0.05 | 0.08 | 0.10 |
| 0.08 | 0.05 | 0.08 | 0.011 | 0.09 | 0.05 | 0.08 | 0.12 |
| 0.17 | 0.14 | 0.19 | 0.20 | 0.19 | 0.15 | 0.19 | 0.20 |
| 0.34 | 0.32 | 0.34 | 0.35 | 0.39 | 0.33 | 0.40 | 0.35 |
| 0.62 | 0.60 | 0.60 | 0.61 | 0.69 | 0.63 | 0.70 | 0.59 |
| 0.97 | 0.94 | 0.96 | 0.93 | 1.04 | 0.95 | 1.06 | 0.83 |
| 1.39 | 1.31 | 1.40 | 1.29 | 1.57 | 1.45 | 1.61 | 1.42 |
| 1.42 | 1.33 | 1.44 | 1.29 | 1.64 | 1.50 | 1.70 | 1.46 |
| 1.20 | 1.11 | 1.22 | 1.10 | 1.49 | 1.33 | 1.54 | 1.26 |
| Colored areas | | | | | | | |
| Black | | | | | | | |
| 1.59 | 1.48 | 1.62 | 1.39 | 1.75 | 1.61 | 1.81 | 1.54 |
| Blue | | | | | | | |
| 1.49 | 1.36 | 1.57 | 0.75 | 1.71 | 1.57 | 1.80 | 0.83 |
| Red | | | | | | | |
| 0.93 | 0.28 | 1.52 | 1.55 | 1.04 | 0.35 | 1.69 | 1.63 |
| Magenta | | | | | | | |
| 0.94 | 0.43 | 1.37 | 0.71 | 1.06 | 0.46 | 1.61 | 0.78 |
| Green | | | | | | | |
| 0.94 | 1.39 | 0.75 | 1.21 | 1.03 | 1.50 | 0.85 | 1.19 |
| Cyan | | | | | | | |
| 0.84 | 1.23 | 0.67 | 0.42 | 0.94 | 1.38 | 0.77 | 0.50 |
| Yellow | | | | | | | |
| 0.21 | 0.15 | 0.21 | 1.16 | 0.28 | 0.20 | 0.29 | 1.18 |

Figure 4:
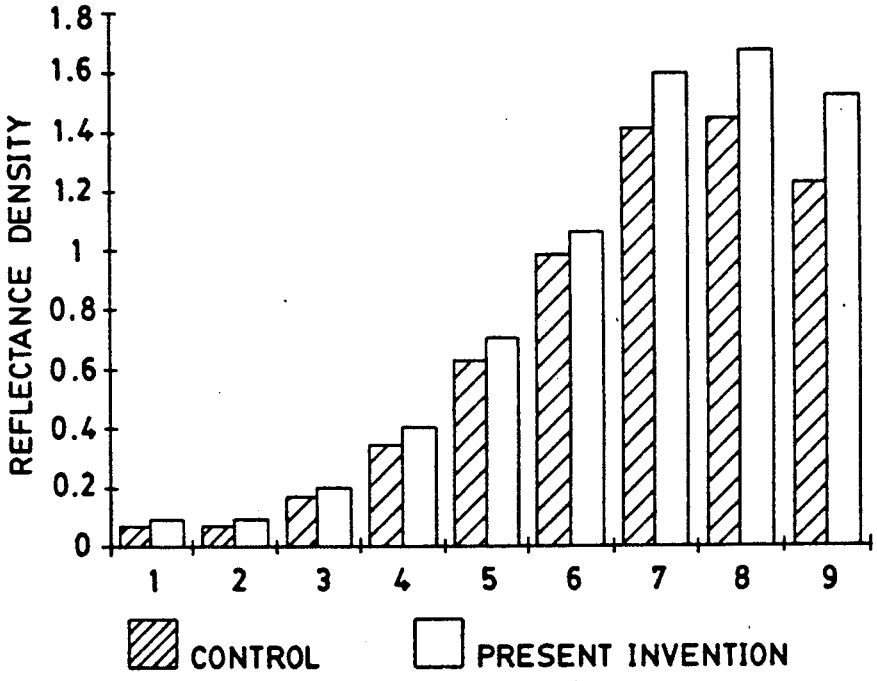
FIG. 4 is a graph showing the improved optical density produced using a thermal imaging process of the present invention, as compared with a control experiment using the same materials, as described in Example 2 below.

From the foregoing data, and especially FIG. 4, it will be seen that the process of the present invention produced images having significantly increased reflectance density and improved resolution, as compared with the control process. The increased reflectance density is attributed to improved uptake of the dye by the polymeric liquid crystal layer on the receiving sheet. This improved dye uptake was confirmed by microscopic examination of sections through the receiving sheet, which showed increased depth of penetration of the dye into the receiving sheet.

Example 3

Preparation and use of receiving sheet of the present invention

This Example illustrates the effect of increasing the amount of polymeric liquid crystal coated onto a receiving sheet of the present invention.

Example 2 was repeated, except that the amount of polymeric liquid crystal coated was increased to 900 mg/ft$^2$., corresponding to a thickness of approximately 6 $\mu$ of pure liquid crystal. Test prints were then made in the same manner as in Example 2, and the reflectance densities for the colored areas are given in Table 3 below.

TABLE 3

| Control | | | | Present Invention | | | |
|---|---|---|---|---|---|---|---|
| Visual | Cyan | Magenta | Yellow | Visual | Cyan | Magenta | Yellow |
| Background | | | | | | | |
| 0.05 | 0.05 | 0.07 | 0.07 | 0.06 | 0.07 | 0.08 | 0.08 |
| Colored areas | | | | | | | |
| Black | | | | | | | |
| 1.60 | 1.48 | 1.64 | 1.39 | 1.85 | 1.78 | 1.85 | 1.71 |
| Blue | | | | | | | |
| 1.53 | 1.38 | 1.61 | 0.73 | 1.82 | 1.72 | 1.86 | 0.86 |
| Red | | | | | | | |
| 0.79 | 0.16 | 1.49 | 1.49 | 0.95 | 0.29 | 1.72 | 1.90 |
| Magenta | | | | | | | |
| 0.81 | 0.25 | 1.45 | 0.72 | 0.99 | 0.38 | 1.70 | 0.81 |
| Green | | | | | | | |
| 0.95 | 1.45 | 0.72 | 1.17 | 1.24 | 1.92 | 0.97 | 1.52 |
| Cyan | | | | | | | |
| 0.84 | 1.28 | 0.65 | 0.31 | 1.10 | 1.73 | 0.86 | 0.38 |
| Yellow | | | | | | | |
| 0.08 | 0.07 | 0.12 | 1.09 | 0.14 | 0.13 | 0.17 | 1.32 |

From Table 3, it will be seen that the results of this experiment were similar to those obtained in Example 2 above, but the average increase in reflectance density of the print using the sheet material of the present invention, as compared with the control, was greater than in Example 2. The data in Table 3 show that use of a receiving sheet of the invention provided a substantial increase in reflectance density which was well-balanced across the various colored areas; thus, incorporation of a polymeric liquid crystal into the receiving sheet did not distort the color reproduction achieved.

During the experiments described in Examples 2 and 3, it was observed subjectively that the prints obtained from the receiving sheets of the invention appeared sharper than those obtained from the control sheets.

Example 4

Preparation of receiving sheet of the present invention from medium not containing pre-existing image receiving layer This Example illustrates the preparation of a receiving sheet of the present invention from a medium which does not contain a pre-existing image receiving layer, so that the polymeric liquid crystal is the sole image receiving material in the receiving sheet, and also illustrates the use of this receiving sheet in thermal imaging.

Kimdura FPG-150 synthetic paper (sold by Kimberly-Clark Corporation, Neenah, Wis.), which is not intended for thermal imaging and which does not contain an image receiving layer, was coated with the same polymeric liquid crystal as in Examples 2 and 3. The liquid crystal was formed into a 10% solution in chloroform and applied to the synthetic paper using a loop coater to achieve a coverage of approximately 750 mg/ft$^2$., corresponding to a thickness of pure liquid crystal of about 5 $\mu$. The resulting receiving sheet was then printed using a Hitachi VY-100A printer in the same way as in Examples 2 and 3. Since the uncoated synthetic paper will not itself function as a receiving sheet, the same receiving sheet as in Examples 2 and 3 was used as a control. The results obtained are shown in Table 4 below.

TABLE 4

| Control | | | | Present Invention | | | |
|---|---|---|---|---|---|---|---|
| Visual | Cyan | Magenta | Yellow | Visual | Cyan | Magenta | Yellow |
| Background | | | | | | | |
| 0.08 | 0.06 | 0.08 | 0.10 | 0.07 | 0.06 | 0.07 | 0.09 |
| Colored areas | | | | | | | |
| Magenta | | | | | | | |
| 0.88 | 0.27 | 1.45 | 0.73 | 0.99 | 0.28 | 1.64 | 0.85 |
| Cyan | | | | | | | |
| 0.96 | 1.52 | 0.79 | 0.35 | 1.08 | 1.67 | 0.90 | 0.42 |
| Yellow | | | | | | | |
| 0.15 | 0.09 | 0.16 | 1.26 | 0.17 | 0.09 | 0.19 | 1.43 |

From the data in Table 4, it will be seen that the synthetic paper coated with polymeric liquid crystal in accordance with the present invention produced reflectance densities superior to those produced by the commercial receiving sheet under the same conditions. Thus, the polymeric liquid crystal layer was able to function as an effective image receiving layer without requiring the presence of another image receiving material.

We claim:

1. A process for thermal imaging using a donor sheet and a receiving sheet, the donor sheet comprising a support and a dye capable of being transferred by heat, the receiving sheet comprising a support and being adapted to receive the dye and thereby form an image, the process comprising placing the donor and receiving sheets adjacent one another, a polymeric liquid crystal being provided on at least one of the donor and receiving sheets so as to be present at the interface between the donor and receiving sheets, and heating selected portions of the donor sheet so as to transfer dye from the donor sheet to the receiving sheet, thereby forming an image on the receiving sheet.

2. A process according to claim 1 wherein the donor sheet comprises a dye layer disposed on one face of the support, the dye layer comprising the dye and a binder for the dye, and during the heating the dye layer on the support faces the receiving sheet.

3. A process according to claim 2 wherein the binder comprises a vinyl alcohol/vinyl butyral copolymer.

4. A process according to claim 2 wherein a layer of a lubricating agent is provided on the face of the donor sheet remote from the dye layer, the lubricating agent serving to reduce adhesion of a thermal printing head to the donor sheet.

5. A process according to claim 1 wherein the receiving sheet comprises the polymeric liquid crystal.

6. A process according to claim 5 wherein the receiving sheet comprises a layer of polymeric liquid crystal layer from about 0.5 to about 10 $\mu$ thick on the support.

7. A process according to claim 6 wherein the polymeric liquid crystal layer on the receiving sheet is from about 1 to about 6 μ thick.

8. A process according to claim 5 wherein the polymeric liquid crystal comprises a polymeric polyester.

9. A process according to claim 8 wherein the polymeric liquid crystal comprises a polymer of an aliphatic dicarboxylic acid and an aromatic dihydroxylic phenol.

10. A process according to claim 9 wherein the aliphatic dicarboxylic acid comprises azelaic acid and the aromatic dihydroxylic phenol comprises at least one of a methylquinol and 4,4'-bisphenol.

11. A process according to claim 8 wherein the polymeric liquid crystal comprises a polymer containing residues of an aromatic hydroxy acid or an aromatic dicarboxylic acid and an alkylene glycol.

12. A process according to claim 11 wherein the polymer comprises residues of at least one of p-hydroxybenzoic acid, a phthalic acid, and a halophthalic acid, and residues of ethylene glycol.

13. A process according to claim 5 wherein the polymeric liquid crystal is the only component of the receiving sheet adapted to receive the dye and thereby form an image.

14. A process according to claim 5 wherein the receiving sheet comprises an image receiving material which is not a liquid crystal.

15. A process according to claim 14 wherein the image receiving material comprises an acrylate polymer or a polycarbonate.

16. A process according to claim 15 wherein the image receiving material comprises poly(methyl methacrylate).

17. A process according to claim 1 wherein heating of the donor sheet is effected by means of a thermal printing head which is scanned over a plurality of areas of the donor sheet to effect an imagewise transfer of dye from the donor sheet to the receiving sheet.

18. A process according to claim 17 wherein the duration of contact between the thermal printing head and the various ones of the plurality of areas of the donor sheet is varied to vary the reflectance density of the various parts of the image produced.

19. Sheet material for use in thermal imaging, the sheet material comprising a donor sheet and a receiving sheet, the donor sheet comprising a support and a dye capable of being transferred by heat, and the receiving sheet having on one of its faces an image receiving layer comprising a polymeric liquid crystal.

20. Sheet material according to claim 19 wherein the donor sheet comprises a dye layer disposed on one face of a support, the dye layer comprising the dye and a binder for the dye.

21. Sheet material according to claim 20 wherein a layer of a lubricating agent is provided on the face of the donor sheet remote from the dye layer, the lubricating agent serving to reduce adhesion of a thermal printing head to the donor sheet.

22. Sheet material according to claim 19 wherein the image receiving layer comprises a layer of polymeric liquid crystal from about 0.5 to about 10 μ thick.

23. Sheet material according to claim 22 wherein the polymeric liquid crystal layer is from about 1 to about 6 μ thick.

24. Sheet material according to claim 19 wherein the polymeric liquid crystal comprises a polymeric polyester.

25. Sheet material according to claim 24 wherein the polymeric liquid crystal comprises a polymer of an aliphatic dicarboxylic acid and an aromatic dihyroxylic phenol.

26. Sheet material according to claim 25 wherein the aliphatic dicarboxylic acid comprises azelaic acid and the aromatic dihyroxylic phenol comprises at least one of a methylquinol and 4,4'-bisphenol.

27. Sheet material according to claim 24 wherein the polymeric liquid crystal comprises a polymer containing residues of an aromatic hydroxy acid or an aromatic dicarboxylic acid and an alkylene glycol.

28. Sheet material according to claim 27 wherein the polymer comprises residues of at least one of p-hydroxybenzoic acid, a phthalic acid, and a halophthalic acid, and residues of ethylene glycol.

29. Sheet material according to claim 19 wherein the image receiving layer comprises a mixture of the polymeric liquid crystal and an image receiving material which is not a liquid crystal.

30. Sheet material according to claim 19 wherein the image receiving layer comprises an acrylate polymer.

31. Sheet material according to claim 30 wherein the image receiving layer comprises poly(methyl methacrylate).

32. Sheet material according to claim 19 wherein, in addition to the image receiving layer comprising a polymeric liquid crystal, the receiving sheet comprises a second image receiving layer formed from a material which is not a liquid crystal, this second image receiving layer being in contact with the polymeric liquid crystal layer on the side thereof remote from the surface of the receiving sheet.

* * * * *